US005967449A

United States Patent [19]

Thomas et al.

[11] Patent Number: 5,967,449

[45] Date of Patent: Oct. 19, 1999

[54] WINDER AND METHOD FOR THE CONTINUOUS WINDING OF A MATERIAL WEB

[75] Inventors: Roland Thomas, Heidenheim; Ralf Preising, Holzkirch; Roland Moeller, Herbrechtingen, all of Germany

[73] Assignee: Voith Sulzer Papiermaschinen GmbH, Germany

[21] Appl. No.: 09/012,956

[22] Filed: Jan. 26, 1998

[30] Foreign Application Priority Data

| | | | |
|---|---|---|---|
| Jan. 25, 1997 | [DE] | Germany | 197 02 715 |
| Oct. 11, 1997 | [DE] | Germany | 197 45 005 |

[51] Int. Cl.[6] ..... B65H 18/14

[52] U.S. Cl. ..... 242/541.1; 242/541.6; 242/542.3

[58] Field of Search ..... 242/541.1, 541.4, 242/541.5, 541.6, 541.7, 547, 542.3

[56] References Cited

U.S. PATENT DOCUMENTS

| | | | |
|---|---|---|---|
| 5,251,835 | 10/1993 | Kyytsönen . | |
| 5,370,327 | 12/1994 | Adamski | 242/541.6 |
| 5,375,790 | 12/1994 | Svanqvist | 242/541.1 |
| 5,560,566 | 10/1996 | Bagnato | 242/541.1 |
| 5,577,685 | 11/1996 | Junk | 242/547 |
| 5,673,870 | 10/1997 | Fielding et al. | 242/541.1 |
| 5,690,298 | 11/1997 | Rück | 242/542.3 |

FOREIGN PATENT DOCUMENTS

| | | |
|---|---|---|
| 697347 | 11/1940 | Germany . |
| 4333588 | 4/1994 | Germany . |
| 4304469 | 8/1994 | Germany . |
| 4428249 | 2/1995 | Germany . |
| 8100118 | 1/1981 | WIPO . |
| 9606033 | 2/1996 | WIPO . |

*Primary Examiner*—John M. Jillions
*Attorney, Agent, or Firm*—Ostrolenk, Faber, Gerb & Soffen, LLP

[57] ABSTRACT

A winder for continuous winding of a material web, like a paper or board web, on a winding spool to form a wound reel. A contact pressure drum is rotatably supported on a displaceable transport device and the drum itself is displaceable with respect to the transport device to form a widening nip with the wound reel. The transport device also supports a primary bearing for holding an empty spool during the start of the winding process. The bearing for the empty spool is between the contact pressure drum and a secondary bearing for supporting the wound reel in the final winding position. The primary bearing for the initially empty spool is fixed in location on a transport device. The transport device is in turn transportable toward and away from the secondary bearing for the wound reel. The contact pressure drum is supported to move along with the transport device as well as also being displaceable with respect to the transport device to maintain the line pressure during increase in the wound spool diameter.

32 Claims, 3 Drawing Sheets

WINDER AND METHOD FOR THE CONTINUOUS WINDING OF A MATERIAL WEB

BACKGROUND OF THE INVENTION

The present invention relates to a winder for continuously winding a material web, especially a paper or board web, and to a method for continuously winding a web.

Winders and methods of the type addressed here are known from DE 196 07 349, which is equivalent to U.S. application Ser. No. 08/807,485. The known winder comprises a contact pressure drum that is displaced by a pressure-applying device, to press the drum in a defined manner against the circumference of a wound reel and form a winding nip with the reel. The contact pressure drum is arranged on a first transport device that can be moved on a guide. The spool on which the wound reel is wound is rotatably held by a primary bearing as the winding process begins. The primary bearing can be translated with respect to the first transport device for the contact pressure drum with the aid of an additional second transport device.

The winding machine further comprises a secondary stationary bearing, which holds the spool to rotate at a fixed position during the final winding process.

At a spool change, an empty spool is introduced into the primary bearing, the material web is severed and its free end is wound onto the empty spool. During start of the winding, while the spool is being held by the primary bearing, the increasing wound reel diameter is compensated for or set by displacing the first transport device and controlling the line force in the winding nip between the contact pressure drum and the wound reel by relative movement of the contact pressure drum with respect to the first transport device. After it reaches a desired wound reel diameter, the wound reel is transferred into the secondary bearing where it is finally wound.

Known winders are relatively complicated to construct and are thus of high cost. This is particularly caused by the second transport device that bears the primary bearing, because an additional control unit is necessary for controlling its displacement. When the wound reel is transferred into the secondary bearing, it is difficult to control the movement of the two transport devices synchronously such that at the same time the control of the line force is able to maintain the desired line force. Instead, there is the risk of a step change in the line force.

DE 44 15 324 A1 which corresponds to U.S. Pat. No. 5,577,685 discloses a winder which has a first, horizontally movable transport device, to which a vertically movable second transport device is fitted. A contact pressure drum, which forms a winding nip with a wound reel, is rotatably supported on the second transport device. The drum can be moved backward and forward relative to the second transport device by a pressure applying device, in order to set the line force in the winding nip. A third transport device is also provided for transferring an empty spool from a ready position into the winding start position, which is located at a lower level. At a spool change, the contact pressure drum is first moved vertically upward into a transfer position. There the contact pressure drum forms a winding nip with an empty spool that is rotatably held on the third transport device. The material web is now severed and its free end is wound onto the empty spool. The spool is subsequently transferred, together with the contact pressure drum, into the winding start position located at a lower level. To this end, the second and the third transport devices are moved vertically downward. During the start of winding and the transfer into the winding start position, the new spool, together with the wound reel wound thereon which has only a few wound layers, is driven by means of a primary drive. From the winding start position, the wound reel is moved horizontally into a final winding position, in which the primary drive is uncoupled and a secondary drive is coupled to the wound reel. The secondary drive drives the wound reel during the further winding process. This winder has a relatively complicated construction, particularly because the second and third transport devices are displaceable independently of each other. Furthermore, control over the displacements of the three transport devices is very complicated.

SUMMARY OF THE INVENTION

It is an object of the present invention to provide a winder and a method of its operation without the foregoing disadvantages. In particular, the wound-on new spool should be displaceable into the stationary secondary bearing in a way which allows maintenance of a desired line force in the winding nip with the least possible effort during the displacement.

In order to achieve this object, a winder for continuous winding of a material web, like a paper or board web, on a winding spool to form a wound reel has a contact pressure drum which is rotatably supported on a displaceable transport device and the drum itself is displaceable with respect to the transport device to form a winding nip with the wound reel. The transport device also supports a primary bearing for holding an empty spool during the start of the winding process. The primary bearing for the empty spool is between the contact pressure drum and a secondary bearing for supporting the wound reel in the final winding position. The primary bearing for the initially empty spool is fixed in location on the transport device. The transport device is in turn transportable toward and away from the secondary bearing for the wound reel. The contact pressure drum is supported to move along with the transport device as well as also being displaceable with respect to the transport device to maintain the line pressure during increase in the wound spool diameter.

The winder has a primary bearing that is arranged in a fixed location on the transport device. Here, "fixed location" is provided by a bearing which holds the spool so that it can rotate and which prevents translational displacement of the spool on the transport device. The primary bearing and the contact pressure drum therefore have a single, common transport device. As a result, structure of the winder and its control can be simplified.

A preferred exemplary embodiment of the winder is distinguished in that while the wound reel is being held by the secondary bearing as it is being finally wound, the increasing wound reel diameter is compensated for by a thrust device that displaces the transport device carrying the contact pressure drum. At the same time, the line force in the winding nip is controlled/regulated by relative movement of the contact pressure drum with respect to the transport device. A controller/regulator is provided for this purpose. It interacts with the pressure-applying device by which the contact pressure drum can be displaced. The displacement of the contact pressure drum relative to the transport device sets the pressure forces in the winding nip between the contact pressure drum and the wound reel. The contact pressure drum has a significantly lower weight than the wound reel, which becomes heavier with increasing diameter, so that rapid compensation of fluctuations and jumps of the line force or of the line force profile occurring in the winding nip is enabled. As a result, the line force can be set extremely finely, which enables a high winding quality to be achieved.

The above-described control or regulation of the line force begins directly at a spool change and remains continuously effective, not only during the winding start process, but also during the common transfer of the new wound spool and the contact pressure drum toward the secondary bearing and during the following final winding process. The significant advantage of the invention arises from the control/regulation of the line force during the winding start process and during transfer of the wound spool into the secondary bearing being performed in a simple and precise manner by simply displacing the contact pressure drum by the pressure-applying device relative to the transport device. Automatic maintenance of the desired line force during the various steps is thus enabled without difficulty and without additional outlay. Only during the final winding process is the maximum stroke of the pressure-applying device generally insufficient to follow the increasing wound reel diameter. Then the thrust device, which is necessary in any case to displace the transport device, draws the transport device, including the contact pressure drum, the pressure-applying device and the now empty primary bearing, gradually away from the secondary bearing, corresponding to the increase in the wound reel diameter.

In an advantageous embodiment of the winder, the primary bearing has a primary drive, preferably a center drive, for the wound reel. This drive applies a defined torque to the spool held by the primary bearing. The primary drive is preferably arranged in a stationary manner in a fixed location on the transport device. This enables the construction of the winder to be further simplified, since additional guide and transport devices are not needed for the primary drive. It is also possible to arrange the primary drive on a separate transport device and, when transferring the wound reel that is rotatably held by the primary bearing to the secondary bearing, to displace the primary drive at the same time parallel to the primary bearing. This arrangement enables torque to be applied to the spool during the entire winding process. As a result, in interaction with the above described control or regulation of the line force in the winding nip, a wound reel having a defined, preferably uniform winding hardness profile can be produced.

In a method for continuously winding a material web, the material web is first led over a circumferential region of a contact pressure drum, which forms a winding nip with the wound reel. In order to prepare a spool change, a free draw of the material web is formed between the contact pressure drum and the almost finished wound reel. An empty new spool is introduced into the region of the free draw in a winding start position. A winding nip is then formed between the contact pressure drum and the empty spool by displacing the contact pressure drum with respect to a transport device which supports the contact pressure drum and the empty new spool. The material web is then severed and its free end is wound onto the new spool which at that time is located in its winding start position, with the control/regulation of the line force in the winding nip beginning immediately. To this end, the contact pressure drum is displaced in a defined way relative to the transport device. After a desired wound reel diameter is achieved, which in the case of a preferred embodiment is only slightly larger than the diameter of the empty spool, the wound reel is transferred into a final winding position, at which the wound reel is rotatably held in a stationary manner during the final winding process. During that transfer, control/regulation of the line force is continued without interruption. In addition, while the wound reel is now located in its final winding position, the line force in the winding nip is further controlled/regulated by relative movement of the contact pressure drum with respect to the transport device carrying the contact pressure drum. At the same time, the increasing wound reel diameter is preferably compensated for by relative movement of the transport device with respect to a base, for example, a foundation, on which the winder stands.

The method described above achieves a desired hardness of the wound reel and hence a very good winding quality uniformly throughout the entire winding process. Furthermore, advantageously, as a result of displacing the contact pressure drum on the common transport device in order to control/regulate the line force in the winding nip, the increasing wound reel diameter is compensated for during the entire winding start process, including the transfer into the final winding position. The outlay for controlling the displacement movements of the contact pressure drum, wound reel and transport device during the entire winding process is therefore relatively low.

Other features and advantages of the present invention will become apparent from the following description of the invention which refers to the accompanying drawings.

DESCRIPTION OF PREFERRED EMBODIMENTS OF THE INVENTION

A winder of the invention described below can generally be used for winding a material web. The winder may be arranged at the outlet end of a machine for producing or finishing a material web, for example a paper web, for winding up the finished material web to form a wound reel. However, the winder may also be used to rewind an already wound coil, also referred to as a wound reel.

Figure 1:
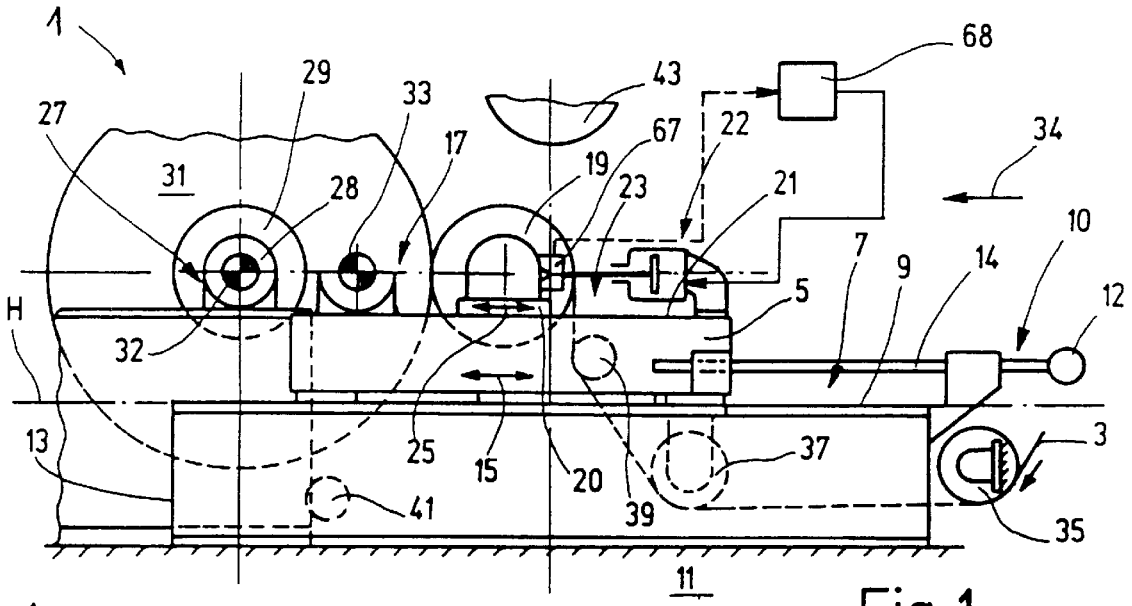
FIGS. 1 to 3 each schematically show the principle of an embodiment of a winder in various winding phases.
Figure 2:
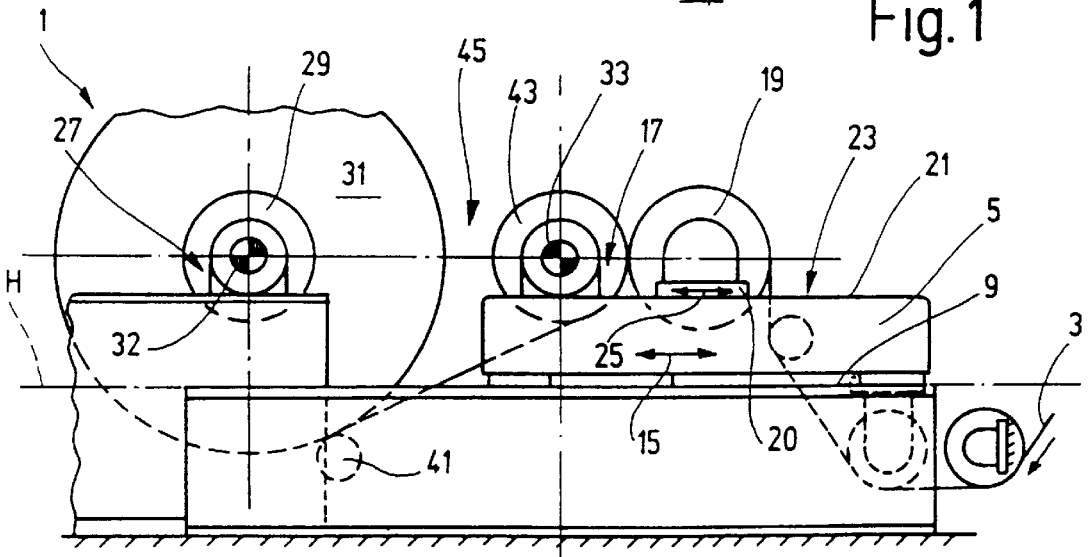
Figure 3:
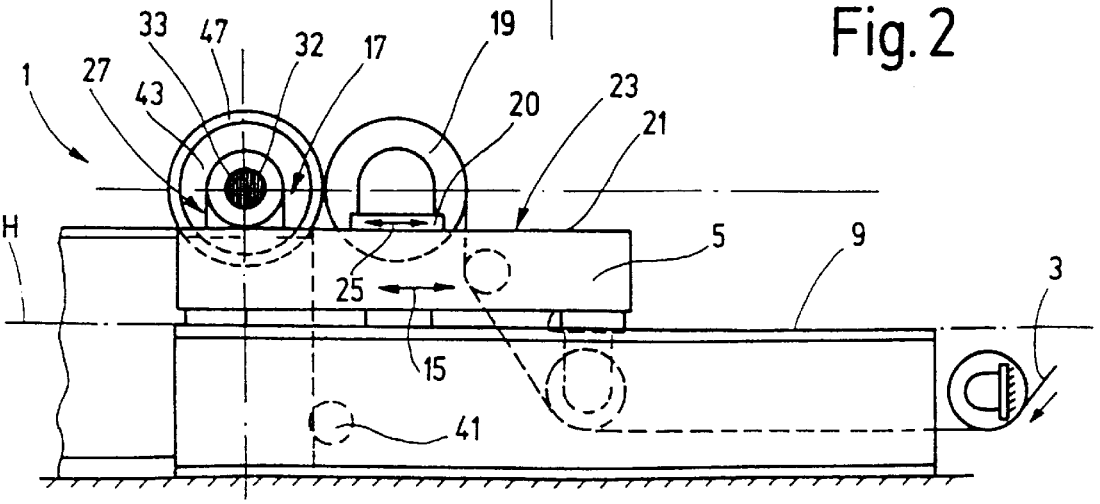

FIGS. 1 to 3 each show a side view of an exemplary embodiment of a winder 1, which is used for winding a material web 3, for example a paper web, onto a spool. The spool can be formed, for example, from a tubular roll. FIGS. 1 to 3 disclose a sequence of functional steps of the winder 1.

The winder 1 includes a transport device 5, also referred to as a carriage, which is movable along a first guide 9 comprised of guide rails 7. The side view of FIGS. 1 to 3 shows only one of the guide rails 7. The guide rails 7 are fastened to a winder frame 13 supported on a foundation 11, and the rails are aligned parallel to an imaginary horizontal H in dash-dot line. A thrust device 10 illustrated in FIG. 1, moves the transport device 5 on the first guide 9 to displace the transport device 5 in the horizontal direction (double arrow 15). The thrust device 10 is fitted to the winder frame 13. The device 10 comprises a spindle drive, which comprises a threaded spindle 14 that is driven by a motor 12. It is also possible, for example, for a hydraulic piston/cylinder unit to be used as the thrust device.

A primary bearing 17, which is illustrated schematically, is arranged on the transport device 5 in a fixed location. The bearing 17 is used for holding or for supporting a spool for rotating during the winding start process. The primary bearing 17 therefore has a fixed position on the movable transport device 5. The "winding start process" refers to the phase of the winding process in which a spool is held by the primary bearing 17.

A contact pressure drum 19, also referred to as a supporting roll, is held rotatably on a guide carriage 20. That carriage is movable on a guide 23 comprised of rails 21, of which only one rail 21 can be seen. The rails 21 are fastened to the transport device 5 and preferably extend parallel, or at least substantially parallel, to the guide rails 7 of the first guide 9. The guide carriage 20 can be moved along the rails 21 (shown by double arrow 25) by a pressure-applying device 22 that is fastened on the transport device 5. The pressure-applying device 22 is a preferably hydraulic, piston/cylinder unit, which comprises a piston guided in a cylinder. A piston rod is fastened to the piston. The other end of the piston rod is connected to the guide carriage 20 or, respectively, the bearing of the contact pressure drum 19 which is fastened to that carriage. The configuration of the pressure-applying device 22 is variable, so that in a different exemplary embodiment, the pressure-applying device 22 can be formed, for example, by a spindle drive. The contact pressure drum 19 may have an adjustable drive torque applied to it, by a center drive that is not illustrated in FIGS. 1 to 3, but which is arranged in a stationary fashion on the transport device 5.

A stationary secondary bearing 27 is fastened to the winder frame 13. The secondary bearing 27 rotationally holds and guides a spool having a bearing journal 28, during the final winding process. In the winding phase illustrated in FIG. 1, the continuously incoming material web 3 is wound onto a spool 29 held by the secondary bearing 27 in order to form a wound reel 31. "Final winding process" refers to that part of the winding process during which the wound reel is held by the secondary bearing 27. The secondary bearing 27 has a secondary drive 32, which is indicated by a symbol, and which drives the spool that is held by the secondary bearing 27. The secondary drive 32 is a center drive, which is fastened to the winder frame 13 and therefore has a fixed position within the winder 1.

In addition, the primary bearing 17 has a primary drive 33, also indicated by a symbol, which applies a defined torque to the respective spool held by the primary bearing 17. In the winder embodiment in FIGS. 1 to 3, the primary drive 33 is arranged stationary on the transport device 5 and is displaced with the transport device 5. This means that no additional guide is needed for the primary drive 33. Therefore, the structure of the winder and its control can be simplified. In a different embodiment, the primary drive 33 is displaceable parallel to the rails 21 of the second guide 23, irrespective of the displacement movement of the transport device 5.

FIG. 1 shows the material web 3 guided from the production or processing machine (not shown) arranged upstream of the winder 1, as viewed in the running direction of the material web 3 (arrow 34), first over a turn roll 35 arranged in a fixed location, and then over a turn roll 37 which is rotatably mounted on the transport device 5. The web 3 is next guided over a third turn roll 39, which is arranged underneath the contact pressure drum 19 and is illustrated with dashed lines, to the contact pressure drum 19. The turn roll 39 is preferably constructed as a web stretch roll.

The material web 3 is guided over a circumferential region of the contact pressure drum 19 of about 180° and is wound onto the wound reel 31 which is held by the secondary bearing 27. The contact pressure drum 19 is pressed against the circumference of the wound reel 31 with a defined force forming a winding nip through which the material web 3 is guided. The line force, also referred to as clamping pressure or clamping force, in the winding nip is controlled by displacing the contact pressure drum 19 on the second guide 23 in the directions of the double arrow 25. In a different embodiment of the winder, the line force in the winding nip may be regulated automatically to a desired value with the aid of a regulator. In both cases, the pressure-applying device 22, which cooperates with the guide carriage 20 carrying the contact pressure drum 19, is influenced in a defined manner. For example, in FIG. 1 a measuring device 67 and a control or regulating unit 68 are indicated schematically. By displacing the contact pressure drum 19, fluctuations in the line force can be compensated for or avoided, achieving a continuously desired winding hardness. The increasing diameter of the wound reel 31, while the wound reel 31 is held by the secondary bearing 27, is compensated for by displacing the transport device 5 and with it the contact pressure drum 19 in the direction opposite to the web running direction (arrow 34), to the right in the illustrated embodiment.

A pinch roll 41 or pressure roll is arranged underneath the wound reel 31 that is held by the secondary bearing 27 and extends over the entire width of the wound reel 31. The roll 41 can be displaced by a guide device, not illustrated, to be pressed against the circumference of the wound reel 31 that forms a winding nip with the contact pressure drum 19. (Compare FIGS. 1 and 2.) The pinch roll 41 prevents air from being dragged between the winding layers of the wound reel 31, for example when the material web 3 is being guided in a free draw. The pressure exerted by the pinch roll 41 against the circumference of the wound reel 31 is adjustable. The pinch roll 41 may be driven by a drive, for example a center drive, preferably before and at least while the pinch roll 41 is pressed against the circumference of the wound reel 31 on the bearing 27.

The operation of the winder 1 is explained below with reference to a winding process. The material web 3 is guided over the contact pressure drum 19 and is wound onto the wound reel 31 that is held by the secondary bearing 27 (FIG. 1). Before the wound reel 31 has attained its final/intended diameter, the pinch roll 41 is pressed against the circumference of the wound reel 31 (FIG. 2). This guides the material web 3 both through the winding nip between the contact pressure drum 19 and the wound reel 31, and through the winding nip between the pinch roll 41 and the wound reel 31.

To transfer the continuous material web 3 onto an empty spool 43 that is arranged in a ready position above the contact pressure drum 19 (FIG. 1), the contact pressure drum 19 is moved to the right by the transport device 5 along the rails 21 of the second guide 23, in a direction opposite to the running direction of the material web 3 (arrow 34) and also preferably at high speed. This increases the distances between the contact pressure drum 19 and the wound reel 31 creating a space 45 (FIG. 2). In the region of the space 45, the material web 3 is transferred in a free draw from the contact pressure drum 19 onto the wound reel 31. During the spool change, the pinch roll 41 is pressed against the circumference of the wound reel 31 with a defined force. This both prevents the dragging of air between the winding layers of the wound reel 31 and assures that an exact hardness of the winding layers wound onto the wound reel 31 can be achieved.

Next, the empty spool 43 is introduced from above into the interspace 45 between the contact pressure drum 19 and the wound reel 31. Before the spool 43 is moved against the material web 3, which is being guided in a free draw, the spool is accelerated to the running speed of the material web 3 by a throw-on device, not illustrated. Movement of the empty spool 43 into the free web draw deflects the material web 3 and guides the web over a circumferential region of the spool 43. The spool 43 is introduced directly into the primary bearing 17, which is arranged in a transfer position, and the new spool is rotatably held by the primary bearing 17 (FIG. 2). The empty spool 43 is then rotationally fixedly connected to the primary drive 33. By displacing the contact pressure drum 19 against the spool 43, a nip or winding nip is formed between the drum 19 and the empty spool 43. The material web 3 is then severed at the free draw between the spool 43 and the roll 41 by a severing device, for example, a known high pressure blast device, not illustrated, and the free end of the web is wound onto the empty spool 43. While the spool 43 is held by the primary bearing 17, the increasing diameter of the wound reel 47 that is wound on the spool 43 (FIG. 3), and the line force in the winding nip between the wound reel and the contact pressure drum 19 is compensated for or controlled/regulated by displacing the contact pressure drum 19. The control/regulation of the line force to set a desired value also automatically compensates for the increasing wound reel diameter by defined displacement of the contact pressure drum 19 relative to the primary bearing 17 that is arranged in a fixed location on the transport device 5.

As seen from FIG. 3, to transfer the wound reel 47 from the winding start position and at the primary bearing 17 into the final winding position, to the secondary bearing 27, the transport device 5 is moved in the web running direction (arrow 34). In the operational position of the winder illustrated in FIG. 3, the wound reel 47 is transferred from the primary bearing 17 to the secondary bearing 27. The secondary drive 32 is now coupled to the spool 43, on which the wound reel 47 is being wound, so that both drives 32 and 33 are briefly effectively connected to the spool 43. Finally, the primary drive 33 of the primary bearing 17 is detached from the spool 43 and may be moved into its transfer position (FIG. 1).

The duration of the winding start process, that is, the period when a wound reel is guided by the primary bearing 17, is variable. It can be a very short time, for example, so that the wound reel has an only relatively low diameter growth. As a result, the maximum stroke of the piston of the pressure-applying device 22 can be kept small. In a preferred embodiment, the maximum stroke of the piston is less than half the material layer thickness of a finished wound reel. It is preferable if the transport device 5 is at a standstill during the introduction of an empty spool into the primary bearing and during an adjustable period after the free end of the material web has been wound onto the empty spool.

The method of operation readily emerges from the description of FIGS. 1 to 3. It comprises the following. To prepare for a spool change, a free draw of the material web is formed between the contact pressure drum and the almost finished wound reel. Next, an empty spool is moved into a winding start position in the region of the free draw. Afterward, the contact pressure drum is relatively moved with respect to a transport device carrying the spool, and the drum is pressed against the circumference of the empty spool, forming a winding nip. The material web is then severed and its free end is wound onto the empty spool. To compensate for the increasing wound reel diameter, while the spool is located in the winding start position, the line force in the winding nip is controlled/regulated. For this purpose, the contact pressure drum is displaced. Then, the winding reel is transferred from the winding start position into the final winding position and continues to be wound here until winding is finished. During these processes, the control/regulation of the line force in the winding nip, by relatively moving the contact pressure drum with respect to the transport device carrying the contact pressure drum, is continued without interruption. The increasing wound reel diameter of the wound reel which is located in the final winding position is now preferably additionally compensated for by relative movement of the entire transport device 5 with respect to a base, the foundation 11. This enables the maximum piston stroke of the pressure-applying device 22, as already mentioned above, to be kept relatively small.

Figure 4:
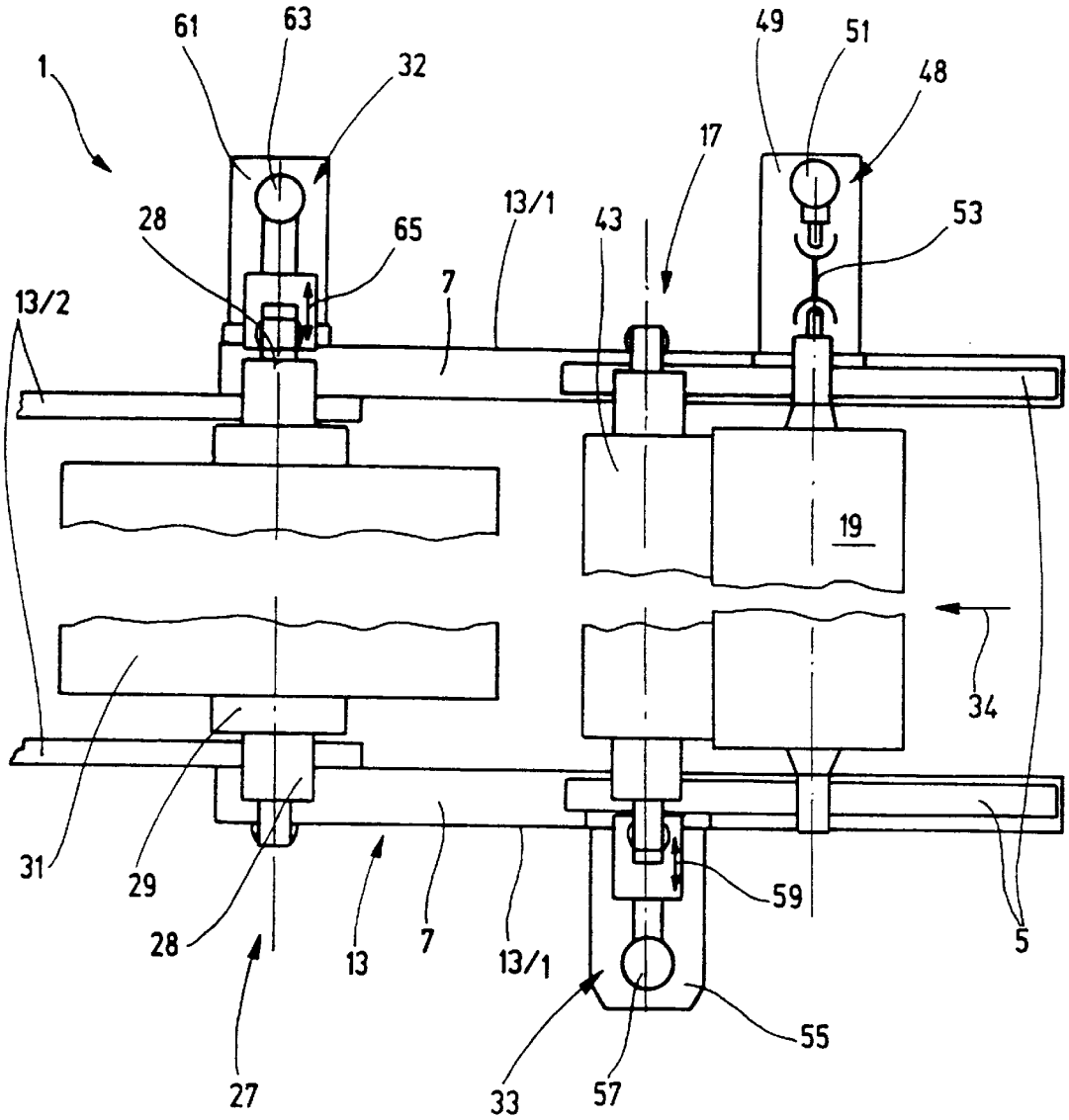
FIG. 4 shows a schematic plan view of the winder of FIGS. 1 to 3 and FIGS. 5 and 6 each schematically show the principle of a further embodiment of the winder.

FIG. 4 is a schematic plan view of the winder 1 of FIGS. 1 to 3. Identical parts are provided with the same reference symbols. The functional position in FIG. 4 corresponds to FIG. 2. The winder frame 13 has an outer part 13/1 and an inner part 13/2. The guide rails 7 of the first guide 9 are fastened on the outer part 13/1 of the winder frame 13.

A center drive 48 for the contact pressure drum 19 is arranged on the drive side of the winder 1 for applying torque to the rotationally mounted contact pressure drum 19. The center drive 48 is fitted to a bracket 49 fastened to the transport device 5. It comprises a motor 51 and an articulated shaft 53, which is connected to a bearing journal of the contact pressure drum 19. The articulated shaft 53 enables the contact pressure drum 19 on the guide rails 7 to move relative to the transport device 5 and thus to move relative to the motor 51 that is arranged on the device 5 in a fixed location, without the drive train having to be interrupted, so that the articulated shaft 53 should be separated from the contact pressure drum or the motor. The contact pressure drum 19 therefore has a torque permanently applied to it.

Furthermore, a bracket 55 is fastened to the transport device 5 on the front side of the winder 1 for carrying the primary drive 33 of the primary bearing 17. The primary drive 33 comprises a motor 57 which, as a double arrow 59 indicates, can be coupled to a replacement spool 43 guided by the primary bearing 17.

A bracket 61 which supports the secondary drive 32 is fastened to the outer part 13/1 of the winder frame 13 on the drive side of the winder 1. The secondary drive 32 comprises a motor 63 which double arrow 65 indicates can be coupled to the spool 29 held by the secondary bearing 27.

Arranging the primary drive 33 and the secondary drive 32 on opposite sides of the winder 1, i.e. the front side and drive side, respectively, enables a spool to have a torque applied to it during the entire winding process. This is explained below with reference to the transfer of the spool 43 from the winding start position into the final winding position.

Before the spool 43 that is being guided by the primary bearing 17 is transferred into the final winding position, the secondary drive 32 is separated from the spool 29 on which the finished wound reel 31 is being wound. The wound reel 31 is moved out of the secondary bearing 27, so that the spool 43 that is being held by the primary bearing 17 and driven by the primary drive 33 can be picked up. The spool 43 is transferred from the winding start position illustrated in FIG. 4 into the final winding position by displacing the transport device 5 in the direction of the arrow 34. Transfer of the spool 43 from the primary bearing 17 to the secondary bearing 27 then takes place. The secondary drive 32 is then coupled to the spool 43. This produces the operational position of the winder 1 illustrated in FIG. 3, in which both the primary drive 33 and the secondary drive 32 are simultaneously coupled and are effectively connected to the spool 43. After the secondary drive 32 has taken over the drive function for the spool 43, the primary drive 33 is uncoupled from the spool 43. The transport device 5 moves the primary drive back into the transfer position, in which a new empty spool can be taken over by the primary bearing 17.

Figure 5:
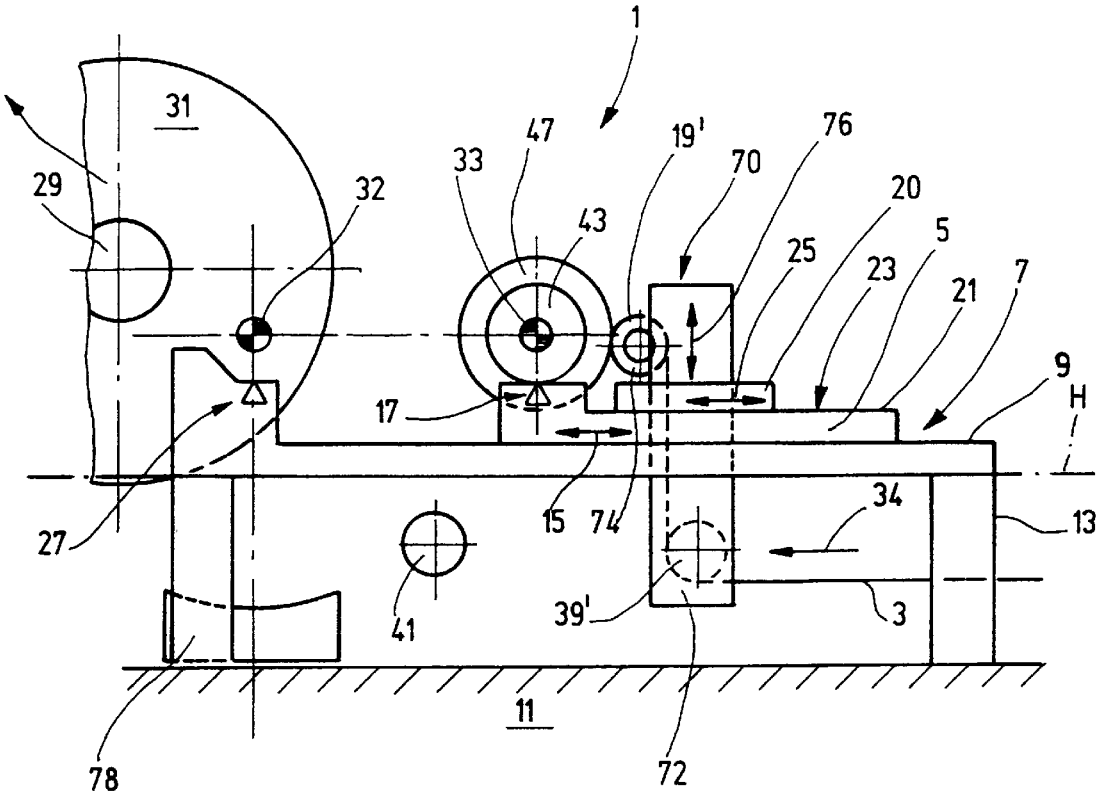
Figure 6:
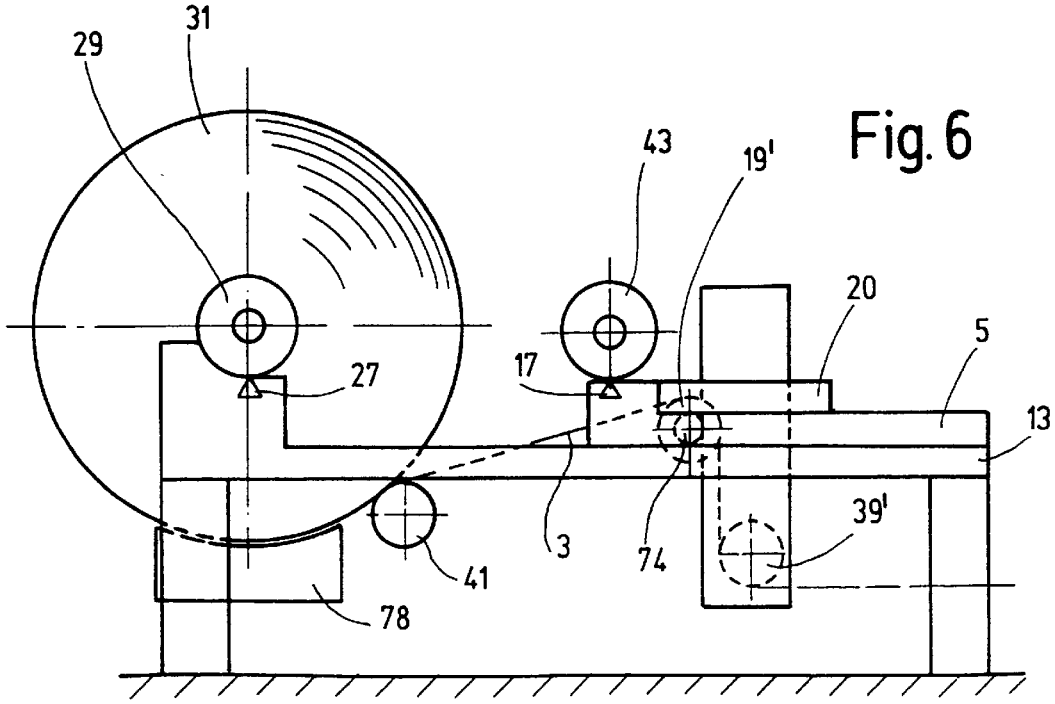

FIGS. 5 and 6 are schematic side views of a second embodiment of the winder 1. Parts corresponding to those described in the preceding Figures are provided with the same reference symbols, so that reference can be made to the description relating to FIGS. 1 to 4. Only the differences are discussed below.

The material web 3 is guided from a processing station for the material web, arranged upstream of the winder 1, to a turn roll 39' and from the roll 39' vertically upward to a contact pressure drum 19'. The drum 19' forms a winding nip against a wound reel 47 located in the winding start position. The previously finished wound reel 31 (with spool 29) is being simultaneously removed from the winder in FIG. 5. The contact pressure drum 19' in FIG. 5 is formed by a contact pressure roll which has a relatively small diameter relative to the reel 43. The diameter is distinctly smaller than the outer diameter of the contact pressure drum 19 illustrated in FIGS. 1 to 4. The weight of the contact pressure drum 19' is preferably also lower than that of the drum 19.

A displacement device 70 arranged on the guide carriage 20 has a guide frame 72 that is fastened to the guide carriage 20 and guides a vertical movable carriage 74 in the directions shown by a double arrow 76. The contact pressure drum 19' is rotatably held on the carriage 74 and is driven by a center drive (not illustrated), which is preferably arranged in a fixed location on the vertical carriage 74. Vertically downward motion of the vertical carriage 74 reduces the distance between the contact pressure drum 19' and the turn roll 39' that is supported stationary on the guide frame 72, as explained below. The vertical displacement travel of the contact pressure drum 19' is preferably relatively small, particularly one to two times the diameter of the contact pressure drum 19'.

The operation of the winder 1 in FIGS. 5 and 6 is described below with reference to a spool change. First, an interspace, in which the material web is guided in a free draw, is formed between the contact pressure drum 19' and a wound reel held by the secondary bearing 27. For this, the transport device 5 is moved to the right, into the position illustrated in FIG. 5. The contact pressure drum 19' is then displaced downward by lowering the vertical carriage 74, so that during the introduction of an empty spool 43 into the winding start position, the spool can be offset in the primary bearing 17 without deflecting the material web 3, which is being guided in a free draw from the contact pressure drum 19' to the almost finished wound reel 31 held by the secondary bearing 27, as seen in FIG. 6. This permits the empty spool 43 to be transferred to the primary bearing 17 during the running winding process, without the empty spool previously having been set rotating. This is a result of the spool 43 not coming into contact with the running material web. Only briefly and before a spool change, the new spool is accelerated to the web speed by the primary drive 33. The contact pressure drum 19' is then displaced vertically upward. This lays the material web 3 against a circumferential region of the empty spool 43 and the web is guided over the spool. A nip is then formed between the contact pressure drum 19' and the empty spool 43 by horizontal displacement of the contact pressure drum 19'. The material web 3 is severed and its free end is wound onto the empty spool. During the winding start process (FIG. 5), the completed wound reel 31 is braked and then removed. The transport device 5 then moves to the left in FIG. 5 and transfers the wound new spool 43/47 to the secondary bearing 27. This condition corresponds to that in FIG. 3.

In a further embodiment, not illustrated, the nip or winding nip between the contact pressure drum 19' and the empty spool is already to be formed during the vertical displacement of the contact pressure drum 19'.

Using the vertically displaceable contact pressure drum 19' avoids a need for a web throw-on device, which is needed in the winder of FIGS. 1 to 4. In the winder of FIGS. 5 and 6, the empty spool is accelerated to the running speed of the material web by the primary drive 33, which is preferably arranged in a fixed location on the transport device 5, and the spool is driven by the drive 33 for a specific time, even after the spool change. Only after the wound spool has been transferred into the secondary bearing is the secondary drive 32 activated and the primary drive 33 detached.

The empty spool 43 can be lowered from the ready position down to the winding level and be accelerated to the web speed only at the ready position. As a result, only two drives, which are preferably center drives, are needed for the spool, in order to apply a drive and/or braking torque to the spool during the entire winding process. Since the center drive for the empty spool need not be moved vertically but is moved only horizontally, in a preferred embodiment, only one of the two center drives is assigned to a spool during the entire winding process, which improves the winding quality. Therefore, the primary drive 33 and the secondary drive 32 must be displaceable horizontally, independently of each other and of the transport device 5.

The vertical mobility of the contact pressure drum 19' makes it also possible to dispense with a hold-down device, known per se, which deflects the material web guided in a free draw. This enables the empty spool to be moved into the primary bearing without first having to be accelerated to web running speed.

FIG. 6 shows that the secondary bearing 27 includes a reel support 78, which supports the outside of the wound reel held by the secondary bearing 27 over a circumferential region, and relieves the bearing of load, so that the wound reel does not sag or its sag is only slight. The reel support 78 is arranged underneath the secondary bearing 27 and may for example, have two turn rolls and at least one circulating belt that is guided over them. The structure of the reel support 78 is a matter of choice and other designs of the reel support are possible. Supporting the wound reel while it is located in the final winding position improves the winding quality.

Common to all of the embodiments of FIGS. 1 to 6 is that the pinch roll 41 can be pressed against the circumference of the wound reel guided by the secondary bearing not only during a spool change, but also during the entire time in which the spool and, respectively, the wound reel wound thereon, is guided and held by the secondary bearing. Winding quality can be thereby improved.

In a preferred embodiment, the contact pressure drum 19 has measuring sensors 67 for the bearing forces at its bearing points. The contact pressure, with which the contact pressure drum 19 is pressed against the circumference of an empty spool 29 or 43 and subsequently against the wound reel 31 or 47 wound thereon, is controlled as a function of the measured signals from the measuring sensors by a control or regulating device 68.

Because the primary bearing is in a fixed location on the transport device, the structure of the winder can be simplified with respect to the known winders. In addition, the winder can be reliably controlled/regulated with a relatively low cost outlay.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A winder for the continuous winding of a web of material for forming a wound reel on a spool, the winder comprising:

a primary bearing for supporting a spool on which a web is to be wounds the primary bearing being moveable;

a secondary bearing, the primary bearing being movable toward and away from the secondary bearing, and the secondary bearing also being adapted to support the spool;

a displaceable transport device having a first part on which the primary bearing is supported, the first part of the transport device being displaceable with respect to the secondary bearing, and having a second part which is movably coupled to the first part and which is displaceable with respect to the first part in a direction that is substantially parallel with a direction that the first part is displaceable;

a pressure applying device supported on and moveable with the second part of the transport device and positioned so as to engage and form a winding nip with the wound reel when the spool is supported on the primary bearing or on the secondary bearing, the pressure applying device having a circumferential portion over which the web is guided;

the primary bearing being arranged in a fixed location on and being moveable along with the first part of the transport device and at a location normally between the pressure applying device and the secondary bearing until the primary bearing is transported by the transport device up to the secondary bearing.

2. The winder of claim 1, further comprising a controller/regulator connected with the pressure applying device for influencing the line force in the winding nip.

3. The winder of claim 1, further comprising a thrust device for displacing the displaceable transport device toward and from the secondary bearing.

4. The winder of claim 1, wherein the pressure applying device comprises a contact pressure drum.

5. The winder of claim 4, further comprising a displacement device supporting the contact pressure drum for being moveable substantially vertically across the direction of displacement of the transport device.

6. The winder of claim 5, wherein the displacement device is arranged on a guide carriage for the contact pressure drum.

7. The winder of claim 1, further comprising a primary drive connected with the primary bearing for rotating the wound reel at the primary bearing.

8. The winder of claim 7, wherein the primary drive is a center drive for the center of the wound reel at the secondary bearing.

9. The winder of claim 7, wherein the primary drive is at a fixed location on and therefore moves with the transport device.

10. The winder of claim 7 further comprising a secondary drive connected with the secondary bearing for rotating the wound reel at the secondary bearing.

11. The winder of claim 10, wherein the secondary drive is a center drive for the center of the wound reel at the secondary bearing.

12. The winder of claim 1, further comprising a first guide for the transport device along which the first part of the transport device moves relative to the secondary bearing.

13. The winder of claim 12, wherein the first guide comprises a guide rail extending toward the secondary bearing on which the transport device is displaceable.

14. The winder of claim 13, wherein the guide rail is at least substantially horizontal.

15. The winder of claim 12, wherein the second part of the transport device comprises a guide carriage supported on the first part of the transport device;

the pressure applying device being supported on the guide carriage;

and the pressure applying device being moveable with respect to the first part of the transport device on the guide carriage.

16. The winder of claim 15, further comprising a second guide for supporting the guide carriage.

17. The winder of clam 16, wherein the second guide comprises a rail disposed on the first part of the transport device and extending toward the secondary bearing.

18. The winder of claim 1, wherein the pressure applying device is moveable with respect to the transport device on which the pressure applying device is supported to maintain the winding nip as the diameter of the wound reel changes.

19. The winder of claim 18, wherein the pressure applying device is moveable along the transport device with a maximum stroke of less than half the material layer of thickness of a finished wound reel.

20. The winder of claim 19, wherein the pressure applying device comprises a hydraulic-piston/cylinder unit with a piston having a maximum stroke of less than half the material layer of thickness of a finished wound reel.

21. The winder of claim 17, wherein the first guide also comprises a guide rail extending toward the secondary bearing on which the transport device is displaceable.

22. The winder of claim 21, wherein the guide rail of the first guide is substantially parallel to the guide rail of the second guide for the guide carriage of the pressure applying device.

23. The winder of claim 16, wherein the pressure applying device is moveable exclusively along the first and second guides and essentially horizontally.

24. The winder of claim 1, wherein the pressure applying device comprises a rotatable contact pressure drum and the winder further comprises a drive for driving the contact pressure drum to rotate.

25. The winder of claim 1, further comprising a pinch roll moveable against the outer surface of the wound reel at the location of the secondary bearing.

26. A method for winding a continuous material web onto a spool to form a wound reel, the method comprising the following steps:

guiding the material web over a partial circumferential region of a pressure applying device, holding the pressure applying device against the wound reel and guiding the material web through a winding nip formed between the pressure applying device and the wound reel;

moving the pressure applying device with respect to the wound reel to form a free draw of the material web between the circumferential region of the pressure applying device and the almost finished wound reel;

introducing an empty spool into the region of the free draw in a winding start position;

moving the pressure applying device to form a new winding nip between the pressure applying device and the empty spool;

severing the material web at a location before the wound reel;

winding the free end of the material onto the empty spool to form a new wound reel;

controlling/regulating the line force in the winding nip and thereby compensating for increasing wound reel diameter by displacing the pressure applying device with reference to the new wound reel;

transferring, using a single common transport device that carries the pressure applying device and the new wound reel, the new wound reel together with the pressure applying device that forms the new winding nip into a final winding position while the winding process proceeds; and finishing the winding of the new wound reel with continued control/regulation of the line force in the winding nip.

27. The method of claim 25, wherein the pressure applying device is displaced in relation to the transport device carrying the pressure applying device for compensating for the increasing wound reel diameter.

28. The method of claim 27, further comprising compensating for the increased wound reel diameter by also displacing the transport device.

29. The method of claim 26, further comprising forming a second winding nip between the wound reel and a separate pinch roll which presses on the wound reel at least while the material web is being guided in the free draw.

30. The method of claim 26, further comprising moving the empty spool into the winding start position sufficiently to deflect the material web which is being guided in the free draw, so that the web is guided over a circumferential region of the empty spool.

31. The method of claim 26, wherein the empty spool is introduced from above before being introduced into the winding start position;

and further comprising the step of lowering the pressure applying device below the position of introduction of the empty spool from above to an extent that the material web is guided in a free draw from the pressure applying device to the almost finished wound reel when the empty spool has assumed the winding start position.

32. The method of claim 31, further comprising the step of after the empty spool has assumed the winding start position, raising the position of the pressure applying device to wrap the material web partially circumferentially around the spool in the winding start position.

* * * * *